United States Patent [19]

Genord, Jr. et al.

[11] Patent Number: 4,580,821

[45] Date of Patent: Apr. 8, 1986

[54] VEHICLE BODY DOOR HANDLE ASSEMBLY

[75] Inventors: Donald R. Genord, Jr., Roseville; Stanley Kwasiborski, Jr., Hazel Park, both of Mich.

[73] Assignee: General Motors Corporation, Detroit, Mich.

[21] Appl. No.: 638,257

[22] Filed: Aug. 6, 1984

[51] Int. Cl.[4] ..... E05C 21/02

[52] U.S. Cl. ..... 292/336.3; 292/337; 292/DIG. 31

[58] Field of Search ..... 70/237; 292/336.3, 337, 292/113, DIG. 31, DIG. 25

[56] References Cited

U.S. PATENT DOCUMENTS

| | | | |
|---|---|---|---|
| 2,055,688 | 9/1936 | Halinka | 292/173 X |
| 3,081,617 | 3/1963 | McKay | 292/336.3 X |
| 3,433,519 | 3/1969 | Brasseur | 292/336.3 |
| 3,596,955 | 8/1971 | Colell | 292/336.3 |
| 4,052,094 | 10/1977 | Widen | 292/336.3 |

*Primary Examiner*—Richard E. Moore

*Attorney, Agent, or Firm*—Herbert Furman

[57] ABSTRACT

A vehicle body door handle assembly includes a mounting member which is mounted to a flange of the rear portion of the upper portion of a vehicle body door and includes a housing fitting within a cutout in the flange and mounting a pull type handle. The handle is associated with an operating mechanism connected to a vehicle body door lock mounted inside the lower portion of the door. The handle and operating mechanism are mounted outwardly of the rear side wall of the door and access to the handle is provided through the rear open side of the housing and an adjacent recess in the body lock pillar.

6 Claims, 6 Drawing Figures

VEHICLE BODY DOOR HANDLE ASSEMBLY

This invention relates generally to vehicle body door handle assemblies and more particularly to such an assembly which is mounted on the upper portion of the door and operatively connected to a vehicle body door lock mounted within the lower portion of the door.

One of the features of this invention is that the door handle assembly is mounted on the upper portion of the door outwardly of a side wall thereof and is operatively connected to the vehicle body door lock which is located inwardly of such side wall within the lower portion of the door. Another feature is that the door handle assembly includes a pivoted pull type handle which is operated by insertion of the operator's fingers behind the handle through a recessed portion of the adjacent body pillar and through an access opening in the upper portion of the door. A further feature is that the upper portion of the door includes a flange and the door handle assembly includes a housing which is located within a cutout in such flange and opens outwardly and rearwardly thereof, with the handle closing the outer opening of the housing and with the rear opening of the housing providing access to the rear of the handle by the operator's fingers. Yet another feature is that the cutout is in a rear flange of the upper portion of the door and the housing is part of a mounting member which covers such rear flange and mounts both the handle and the operating mechanism connecting the handle to the vehicle body door lock. Yet a further feature is that the housing is an integral part of the mounting member and the handle includes a pair of depending legs which are pivotally mounted to the inner side of the mounting member below the housing, with one of the handle legs providing an operative connection between the handle and the operating mechanism and the other leg providing an operative connection to a biasing spring which biases the handle to a non-operating position within the outer opening of the housing. Still another feature is that the operating mechanism includes a transfer lever which is pivoted to the mounting member and engages one leg of the handle so as to vertically shift a connecting member to operate the vehicle body door lock, with the transfer lever, connecting member and handle being preassembled to the mounting member so that the door handle assembly may be modularized as a unit and be mounted in a simple and expeditious manner to the rear flange of the upper portion of the door. Still a further feature is that the mounting member is secured to the rear flange above the cutout and includes a lower flange which fits over the lower edge portion of the cutout and is held thereagainst by an adjustable member.

These and other features will be readily apparent from the following specification and drawings wherein.

Figure 1:
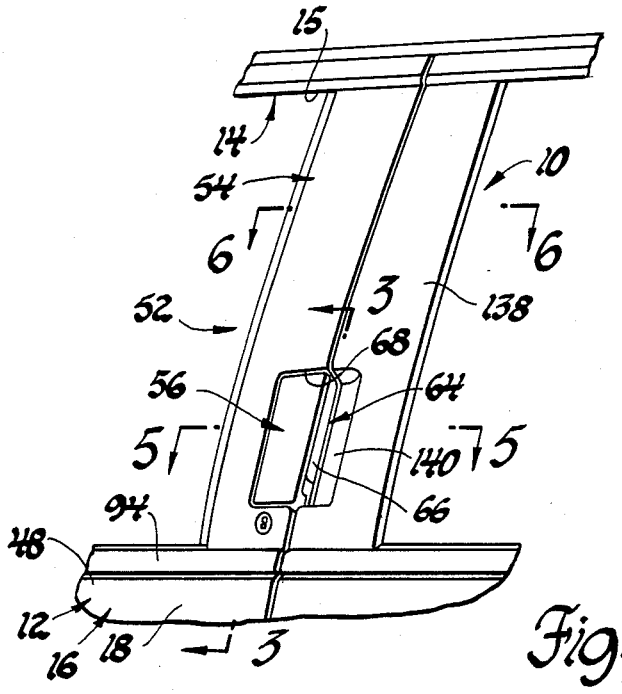
FIG. 1 is a partial view of a two door type of vehicle body embodying a door handle assembly according to this invention.
Figure 3:
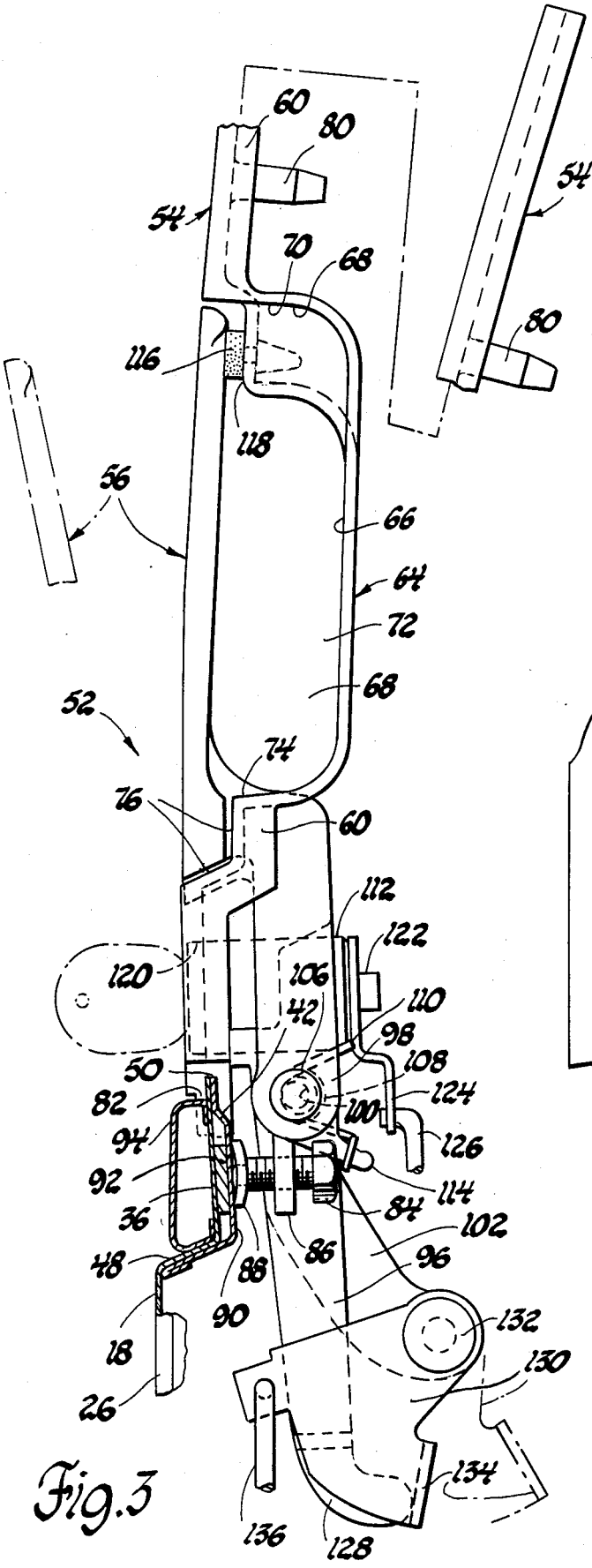

FIG. 3 an enlarged view taken generally along the plane indicated by line 3—3 of FIG. 1.

Figure 4:
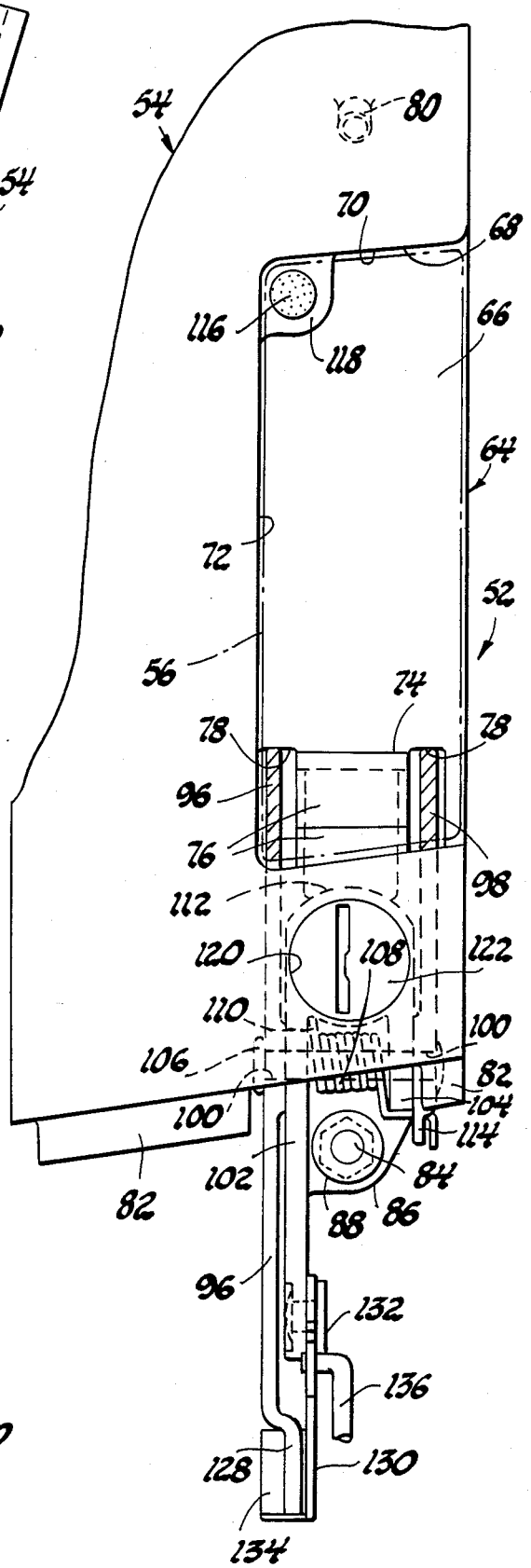

FIG. 4 is an enlarged partially cutaway view of a portion of FIG. 1.

Figure 5:
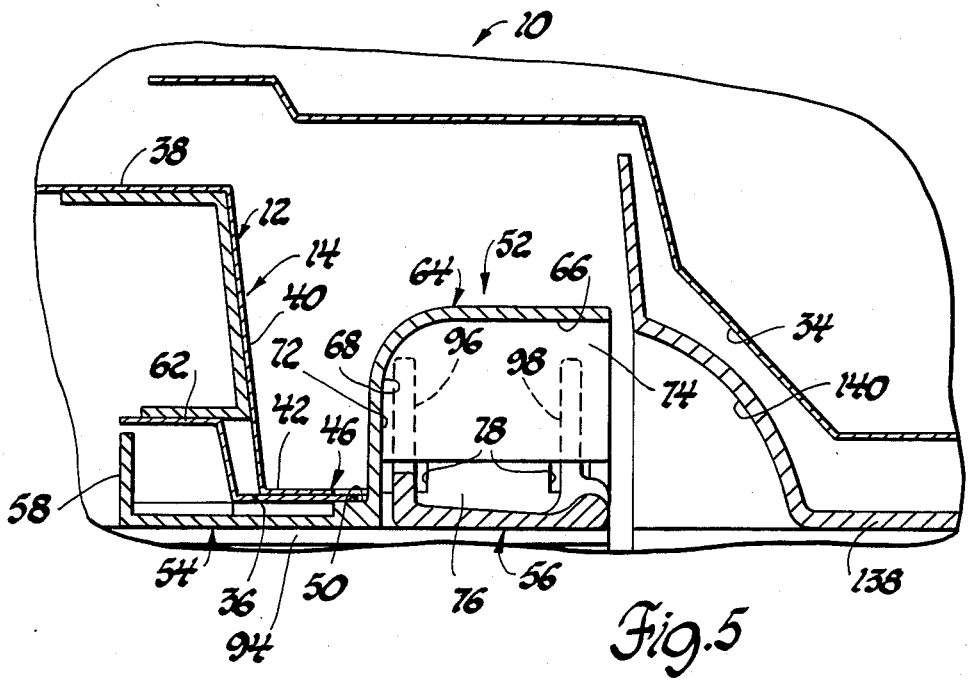
Figure 6:
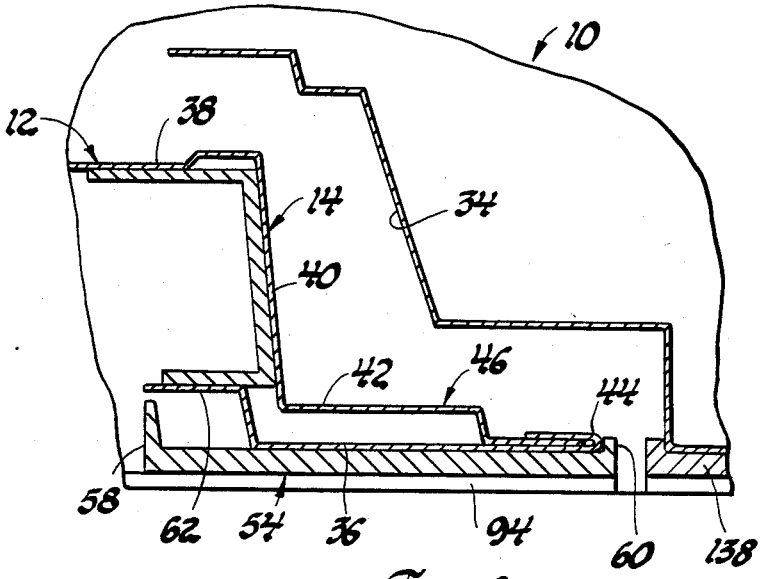

FIG. 5 is an enlarged sectional view taken along line 5—5 of FIG. 1, and FIG. 6 is an enlarged sectional view taken along line 6—6 of FIG. 1.

Referring now particularly to FIGS. 1, 2, 5 and 6 of the drawings, a two door type of vehicle body designated generally 10 includes a front door 12 which is hinged to the body about its forward edge portion, not shown, and latched to the body about its rearward edge portion, not shown, with the forward edge portion being to the left as viewed in FIG. 1 and the rearward edge portion being to the right as viewed in this Figure. The door 12 includes an upper door portion or door frame 14 which defines a window opening 15 and a lower door portion 16. As can be seen from FIGS. 1 and 2, the lower door portion 16 includes a door outer panel 18 and a door inner panel 20. The inner panel 20 includes an integral extension which provides the pillar wall or rear side wall 22 of the door and which terminates in a flange 24 enveloped by a hem flange 26 of the outer panel in a conventional manner. The wall 22 includes an offset 28 which is apertured at 30. The aperture 30 opens to the inside of the lower portion of the door to a conventional vehicle body door lock, not shown, which is mounted to the inner side of the wall 22. A slot 32 in the wall 22 and a portion of the inner panel 20 provides for engagement and disengagement of the lock bolt and of a conventional headed striker pin, not shown, mounted on the adjacent lock pillar wall 34, FIGS. 5 and 6, of the body 10 when the door 12 is opened and closed.

Figure 2:
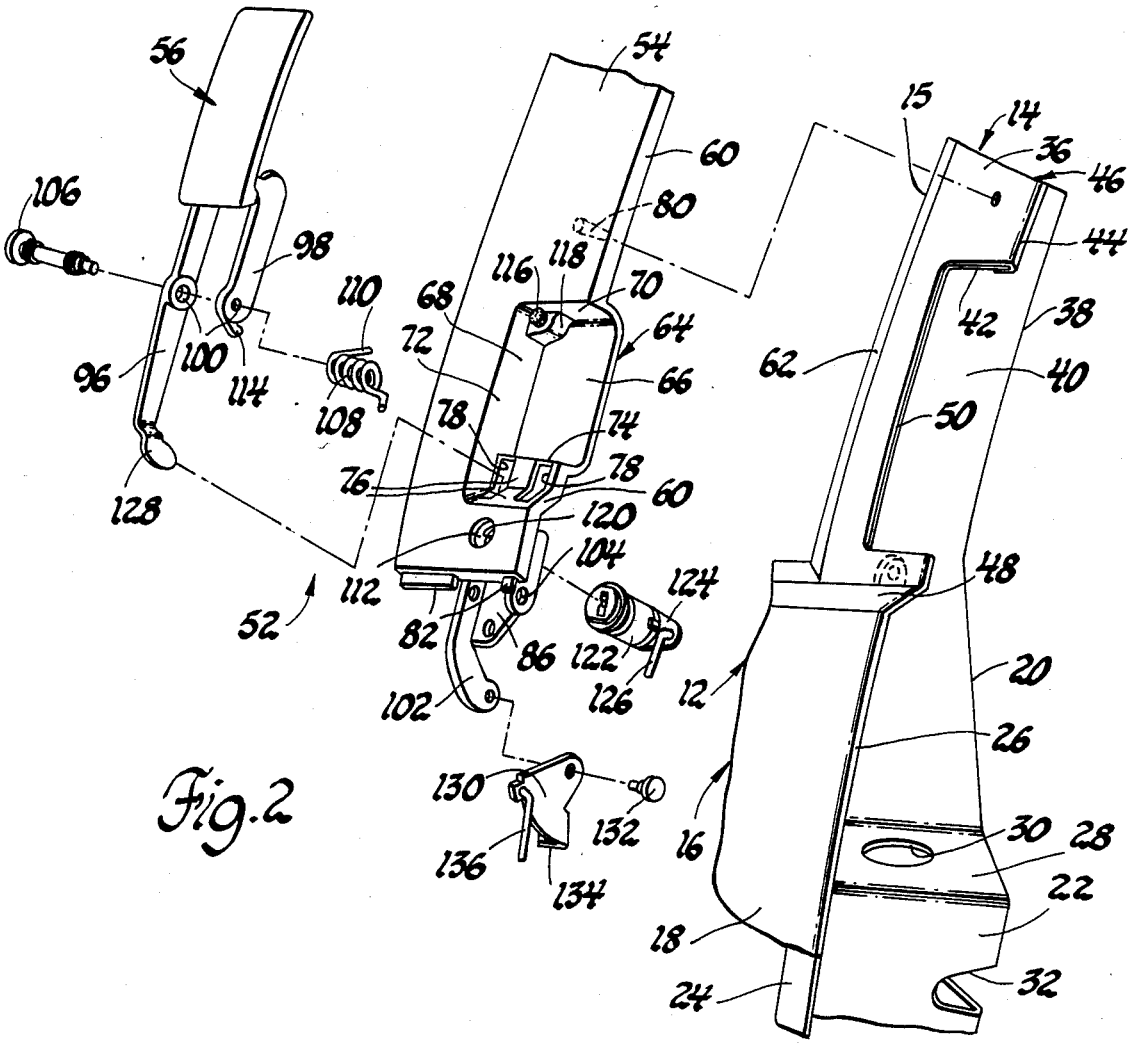
FIG. 2 is an exploded perspective view of a portion of FIG. 1.

The upper door frame 14 of door 12, FIGS. 2, 5 and 6, includes an outer member 36 and an inner member 38. The outer member 36 is formed integral with the outer panel 18 and the inner member 38 is formed integral with the inner panel 20 at the forward and rearward edges of the door frame 14. Along the rear portion of door frame 14, the member 38 includes a flange 40 which extends outwardly thereof and terminates in an integral offset flange 42 extending rearwardly. The outer member 36 is hem flanged at 44 over flange 42. The flange 40 is integral with the wall 22 of the inner panel 20 and provides an upward continuation of the rear side wall of the door 12 as can be seen in FIG. 2. The member 36 and flange 42 cooperatively provide a rear edge flange 46 of door frame 14. The forward and upper portions of the door frame 14 are formed in a similar manner by inner and outer members which are integral with the members 36 and 38 and have their edge portions hem flanged to each other. The lower end of the member 36 integrally merges into the rear end of an integral angular flange 48 of panel 18. Flange 48 extends entirely across the upper edge of the door panel 18 and has its forward end connected to the member 36 of the forward portion of door frame 14.

The rear edge flange 46 of the rear portion of door frame 14 includes a cutout 50 best shown in FIG. 2. Flange 42 seats against and is secured to member 36 around the edge portions of the cutout.

A door handle assembly 52 is mounted to the flange 46, as will be described, and includes a mounting and cover member 54 which covers this flange and is adjustably secured thereto as well as an operating handle 56 which is pivotally mounted to the mounting member 54 and operatively connected to the vehicle body door lock mounted within the lower portion of the door between the inner and outer panels 18 and 20 as previously mentioned. With specific reference to FIGS. 2, 3, 4 and 5, the member 54 is formed of die cast material and includes forward and rearward flanges 58 and 60. The flange 58 extends toward an offset forward flange 62 of the member 36, as shown in FIG. 5, while the flange 60 extends inwardly over the hem flange 44. The member 54 includes an integral housing 64 which includes an inner wall 66 and a side or peripheral wall 68 having an upper portion 70, forward portion 72 and lower portion 74 which join the inner wall to the member 54, as best shown in FIG. 2. The lower wall portion 74 is of stepped type and includes angularly related portions 76 which are slotted at 78. The member 54 includes integral studs 80, FIG. 4, which extend through respective openings in the flange 46 and receive suitable fasteners to the inner side of the flange so as to secure the upper portion of the member 54 to the flange 46 upwardly of cutout 50. As shown in FIG. 3, the lower edge of the member 54 includes offset spaced flanges 82 which fit over the lower edge portion of the cutout 50. A bolt 84 is threaded through a threaded ear 86 of the member 54 and mounts a concave washer 88 on the outer end thereof. As shown in FIGS. 2 and 3, the flange 42 of member 38 is offset at 90 from member 36 below the lower edge portion of the cutout 50 and a reinforcement member 92 fits between the base wall of the offset 90 and the member 36. The engagement of the washer 88 with the offset 90 draws the flanges 82 of the member 54 tightly against the member 36 to releasably secure the lower portion of the member 54 to the flange 46 below the cutout 50. Thus the member 54 is secured to the flange 46 both above and below the cutout 50. As shown in FIGS. 1 and 3, a molding 94 fits between the lower edge of the member 54 and the flange 48 and extends entirely across the upper edge of the lower portion 16 of the door 12.

As shown in FIGS. 1 and 3, the handle 56 is generally of the size of the open outer wall of the housing 64 and includes a pair of integral depending legs 96 and 98, the former of which is longer than the latter. The legs are coaxially apertured at 100. As shown in FIGS. 3 and 4, the legs fit within the slots 78 so as to be located inwardly of the member 54 and straddle integral coaxially apertured legs 102 and 104 of the member 54. A headed pin 106 extends through the apertures 100 and those of the legs 102 and 104 to pivotally mount the handle 56 to the member 54 for movement between an inoperative position within the outer open wall of housing 64, as shown in FIGS. 1 and 3, and an operative position as shown in dash lines in FIG. 3 wherein the handle 56 has been pulled outwardly of the outer open wall of the housing 64. A coil torsion spring 108 surrounds the pin 106 between the legs 102 and 104 and has one leg 110 thereof engaging an integral cylindrical boss 112, FIG. 4, of the member 54 and the other bent leg thereof engaging an extension 114 of leg 98 of the handle 56 to bias the handle inwardly of the housing 64 or clockwise as viewed in FIG. 3 to inoperative position. The handle is located in this position by engagement with a rubber bumper 116 which is self-mounted to an integral stop or shoulder 118 located in the forward upper corner of the housing 64 between the side wall portion 72 and upper wall portion 70 of wall 68.

The boss 112 extends inwardly of the member 54 from an outer circular opening 120, and is integrally joined to ear 86 and legs 102 and 104. A conventional lock cylinder 122 is secured within the boss 112, with key access to the lock cylinder being had through the opening 120. The lock cylinder 122 mounts a conventional operating lever 124 which is connected with the door lock mounted in the lower portion of the door through an operating rod 126 connected to the locking lever of the door lock.

The leg 96 of handle 56 is longer than the leg 98, as previously mentioned, and the extended portion of the leg 96 terminates in an offset foot 128. A bell crank lever 130 is pivoted at 132 to the leg 102 of the member 54 and includes an integral lateral tab 134 which lies in the path of the foot 128. An apertured ear of lever 130 pivotally mounts the upper end of an operating rod 136. The lower end of the rod 136 is connected to the release lever of the door lock. The release lever locates the tab 134 in engagement with the foot 128.

From the foregoing description it can be seen that the member 54 can be preassembled with the handle 56, the lock cylinder 122, the spring 108, and the lever 130 to provide a modularized door handle assembly 52 prior to mounting of the handle assembly on the flange 46 of the upper portion of door frame 14.

As shown in FIGS. 1 and 5, the lock pillar 34 of the body includes an outer cover member 138 having a recess 140 located generally opposite and rearwardly of the cutout 50 and housing 64. The recess 140 opens to the rearward open wall of the housing 64.

If it is desired to release the door lock, the operator inserts his/her fingers through the recess 140 and into the housing 64 behind handle 56 through the rear open wall of the housing. The handle 56 is then pulled outwardly of the housing 64 through the open outer wall thereof and against the bias of spring 108. As the handle pivots counterclockwise as viewed in FIG. 3, the foot 128 of the handle leg 96 engages the tab 134 of the lever 130 to pivot this lever in the same direction as the handle and shift the rod 136 downwardly. The rod operates the release lever of the door lock to release the detent from the lock bolt so that the bolt can move to released position with respect to the striker as door 12 is opened. When handle 56 is released, spring 108 returns it to its inoperative position in engagement with bumper 116. To lock and unlock the door lock, key cylinder 122 is operated. Rods 126 and 136 move through opening 30 of offset 28. A suitable cover may extend between housing 64 and the offset 28 to cover the exposed portion of the door handle assembly.

Thus this invention provides an improved vehicle body door handle assembly.

The embodiments of the invention in which an exclusive property or privilege is claimed are defined as follows:

1. In a vehicle body, the combination comprising, a vehicle body door having a lower portion and an upper door frame portion, said door portions providing the rear side wall and rear outer flange of the door, a door handle housing mounted to the outer flange at the upper door frame portion and opening outwardly and rearwardly of such flange, a door handle closing the outward opening of the housing, the rearward opening of the housing providing access into the housing behing the handle, means mounting the door handle to the housing for movement between a nonoperating position within the outward opening of the housing and an operating position outwardly of the outer opening of the housing, an operator's fingers being insertable behind the handle through the rearward opening of the housing to move the handle outwardly of the housing to operating position, and means extending along the outside of the rear side wall of the door and into the lower portion of the door through an opening in the rear side wall for connecting the door handle to a vehicle body door lock mounted within the lower portion of the door and inside of the rear side wall of the door.

2. In a vehicle body, the combination comprising, a vehicle body pillar having a wall, a vehicle body door having a lower portion and an upper door frame portion, said door portions providing a rear side wall confronting the body pillar wall, and an outer door flange extending laterally to the rear side wall, a door handle housing mounted to the flange at the upper door frame portion and including an inner wall, an open outer wall open at the rear thereof to the body pillar wall, and a lateral side wall, a door handle closing the open outer wall of the housing, means mounting the door handle to the housing for movement between a nonoperating position closing the open outer wall of the housing and an operating position outwardly of the open outer wall of the housing, the handle being spaced from the inner wall of the housing in the nonoperating position to permit insertion of the operator's fingers behind the handle through the rear open side wall of the housing to move the handle outwardly of the housing to operating position, a recess in the body pillar wall opposite the rear open side wall of the housing to facilitate insertion of the operator's fingers, and means extending along the outside of the rear side wall of the door and into the lower portion of the door through an opening in the rear side wall for connecting the door handle to a vehicle body door lock mounted within the lower portion of the door and inside of the rear side wall of the door.

3. In a vehicle body, the combination comprising, a vehicle body door including a lower portion and an upper door frame portion, said door portions providing the door with a rear side wall and an outer flange extending laterally to the rear side wall, the outer flange at the upper door frame portion including a cutout opening rearwardly through the rear edge thereof, a door handle housing located within the cutout and including an inner wall and a lateral side wall extending around the edge of the cutout, the outer wall of the housing being open and the lateral side wall being open at the rear opening of the cutout, means mounting the housing to the upper door frame portion, a door handle fitting within the open outer wall of the housing, means mounting the door handle to the housing for movement between a nonoperating position within the open outer wall of the housing and an operating position outwardly of the open outer wall of the housing, the handle being spaced from the inner wall of the housing in the nonoperating position to permit insertion of the operator's fingers behind the handle through the rear open side wall of the housing to pull the handle outwardly of the housing to operating position, and means extending along the outside of the rear side wall of the door and into the lower portion of the door through an opening in the rear side wall for connecting the door handle to a vehicle body door lock mounted within the lower portion of the door and inside of the rear side wall of the door.

4. In a vehicle body, the combination comprising, a vehicle body door including a lower portion and an upper door frame portion cooperatively providing a door rear side wall and a door rear flange, a door handle housing mounted to the door flange and opening outwardly and rearwardly of the door flange, a door handle closing the outward opening of the housing and including a pair of depending legs extending along the inner side of the door flange, the rearward opening of the housing providing access into the housing behind the handle, means pivotally mounting the door handle legs to the housing for movement of the handle between a nonoperating position within the outward opening of the housing and an operating position outwardly of the outward opening, an operator's fingers being insertable through the rearward opening of the housing and behind the handle to pull the handle outwardly of the housing to operating position, and door lock release means operatively connected to one leg of the handle and extending along the outside of the rear side wall of the door and into the lower portion of the door through an opening in the rear side wall for connecting the door handle to a vehicle body door lock mounted within the lower portion of the door and inside of the rear side wall of the door.

5. In a vehicle body, the combination comprising, a vehicle body door including a lower portion and an upper door frame portion cooperatively providing a door rear side wall and a door rear flange, a door handle housing mounted to the door flange and opening outwardly and rearwardly of the door flange, a door handle closing the outward opening of the housing and including a pair of depending legs extending downwardly of the housing along the inner side of the door flange, the rearward opening of the housing providing access in to the housing behind the handle, means pivotally mounting the door handle legs to the housing for movement of the handle between a nonoperating position within the outward opening of the housing and an operating position outwardly of the outward opening, an operator's fingers being insertable through the rearward opening of the housing and behind the handle to pull the handle outwardly of the housing to operating position, resilient means interconnecting one leg of the handle and the housing and biasing the handle to nonoperating position, door lock release means mounted to the housing and extending along the outside of the rear side wall of the door and into the lower portion of the door through an opening in the rear side wall for connection to a vehicle body door lock mounted within the lower portion of the door and inside of the rear side wall of the door, and means on the other leg of the handle connectable to the release means when the door handle is moved to operating position.

6. In a vehicle body, the combination comprising, a vehicle body door including a lower portion and an upper door frame portion cooperatively providing a door rear side wall and a door rear flange, a door handle mounting member covering the outer side of the door flange along the door frame portion and including a door handle housing recessed inwardly of the door flange and opening outwardly and rearwardly of the door flange, a door handle closing the outward opening of the housing and including a pair of depending legs extending downwardly of the housing along the inner side of the door flange, the rearward opening of the housing providing access into the housing behind the handle, means pivotally mounting the door handle legs to the mounting member below the housing for movement of the handle between a nonoperating position within the outward opening of the housing and an operating position outwardly of the outward opening, an operator's fingers being insertable through the rearward opening of the housing and behind the handle to pull the handle outwardly of the housing to operating position, door lock release means mounted to the mounting member below the door handle pivot and extending along the outside of the rear side wall of the door and into the lower portion of the door through an opening in the rear side wall and connected to a vehicle body door lock mounted within the lower portion of the door and inside of the rear side wall of the door, and means operatively connecting at least one leg of the handle to the release means when the handle is moved to operating position.

* * * * *